US006244504B1

(12) United States Patent
Holland-Letz

(10) Patent No.: US 6,244,504 B1
(45) Date of Patent: Jun. 12, 2001

(54) BANKNOTE CONTAINER FOR CASH DISPENSER

(75) Inventor: Günter Holland-Letz, Paderborn (DE)

(73) Assignee: Siemens Nixdorf Informationssysteme Aktiengesellschaft, Paderborn (DE)

( * ) Notice: Subject to any disclaimer, the term of this patent is extended or adjusted under 35 U.S.C. 154(b) by 0 days.

(21) Appl. No.: 09/254,616

(22) PCT Filed: Sep. 23, 1997

(86) PCT No.: PCT/DE97/02158

§ 371 Date: Mar. 10, 1999

§ 102(e) Date: Mar. 10, 1999

(87) PCT Pub. No.: WO98/14914

PCT Pub. Date: Apr. 9, 1998

(30) Foreign Application Priority Data

Oct. 1, 1996 (DE) ..... 196 40 574

(51) Int. Cl.[7] ..... G07B 15/00
(52) U.S. Cl. ..... 232/15; 902/13
(58) Field of Search ..... 232/15, 16, 31, 232/32, 1 D; 902/9, 13

(56) References Cited

U.S. PATENT DOCUMENTS 4,529,119 * 7/1985 Graznow et al. .
4,580,422 * 4/1986 Wills .
4,597,340 * 7/1986 Huckle .

FOREIGN PATENT DOCUMENTS 44 08 981 C 1 3/1994 (DE) .
0 197 899 2/1985 (EP) .
0 269 731 5/1986 (EP) .
0 280 881 3/1987 (EP) .
2 136 498 3/1983 (GB) .

* cited by examiner

*Primary Examiner*—Anthony Knight
*Assistant Examiner*—James M Hewitt
(74) *Attorney, Agent, or Firm*—Schiff Hardin & Waite

(57) ABSTRACT

In a bill container capable of being pushed into a receiving module and with a front panel actuable by an actuating lever and a detent lever which can be adjusted between a release position, a first intermediate position, which the detent lever assumes as a function of the opening movement of the actuating lever, and a detaining position, in which the detent lever retains the actuating lever in its closing position, the detent lever is coupled to an electromechanical setting device, by means of which, when the bill container is pushed in, the detent lever can be adjusted into a mechanically secured second intermediate position, out of which the detent lever can be adjusted into its release position as a function of the closing movement of the actuating lever.

13 Claims, 6 Drawing Sheets

BANKNOTE CONTAINER FOR CASH DISPENSER

BACKGROUND OF THE INVENTION

FIELD OF THE INVENTION

The present invention relates to a bill or currency container for cashing dispensing machines or automated teller machines.

In a bill container, such as is known from DE-C-44 08 981, the anti-repetition device has the purpose of allowing the cover or the so-called front panel to be opened once when said container is being pushed into the receiving module, so that the front side of the bill stack stored in the bill container is released for the draw-off mechanism of the receiving module. When the lid is being closed after the bill stack has been placed into the bill container, the detent lever of the anti-repetition device is brought into the release position and is brought into the first intermediate position, that is to say activated, during the first movement of the actuating lever in the opening direction. When the actuating lever returns to its closing position, the detent lever then falls out of the first intermediate position into its detaining position, so that the actuating lever is locked. The bill container can then no longer be pushed into the receiving module or, as the case may be, the front panel can no longer be opened.

The thus predetermined operation of opening the panel once only does not make it possible for the bill container to be removed from the receiving module for checking and other purposes, unless the key for opening the lid is readily available, so that the detent lever can be put into its release position again.

When a service for filling up automatic cash dispensers is carried out, the key for the lid remains in the loading station, since the service personnel should not have any possibility of gaining access to the content of the bill containers. In the event of a build-up of bills in the draw-off region and of other faults, however, it would be advantageous if a bill container could be removed from the receiving module, the fault rectified and the bill container subsequently pushed in again.

Thus there is a need for a bill container of the initially mentioned type by simple means, in such a way that the anti-repetition device in the bill container can be overridden as often as desired for maintenance purposes, without reducing the security of the bill container against manipulation during transport between a loading station and the place of use in an automatic cash dispenser.

SUMMARY OF THE INVENTION

The aforementioned need is met according to the present invention, in that the detent lever is coupled to an electromechanical setting device which, when the bill container is pushed in, can be connected to a control device assigned to the receiving module and by means of which, when the bill container is pushed in, the detent lever can be adjusted into a mechanically secured second intermediate position, out of which the detent lever can be adjusted into its release position as a function of the closing movement of the actuating lever.

By means of the solution according to the present invention, it is possible to adjust the detent lever by means of the electromechanical setting device out of the first intermediate position, out of which it would normally fall into the detaining position when the bill container is pulled out of the receiving module and during the closing movement of the actuating lever positively induced thereby, into the second intermediate position, in which said lever is initially locked mechanically. When the bill container is pulled out of the receiving module, admittedly the electric connection between the bill container and the receiving module and therefore also the connection between the electromechanical setting device and the control device is broken. Nevertheless, by virtue of mechanical securing, the detent lever remains in its second intermediate position. The detent lever is transferred out of this into the release position by means of the actuating lever which returns to the closing position. The anti-repetition device is consequently once again in the state, in which it was after the loading of the bill container and the closing of the lid and before said container was first pushed into the receiving module. That is to say, the bill container can be pushed into the receiving module again and, at the same time, the front panel opened. This operation may be repeated as often as desired, so that it is possible, for example, to rectify a build-up of bills in the draw-off device or the like and subsequently push the bill container into the receiving module again.

Preferably, the detent lever is held in its first and second intermediate position in each case by means of a mechanical catch arrangement which can be released as a function of the closing movement of the actuating lever. Such a catch arrangement can be achieved by very simple means by prestressing the detent lever in the direction of a catch contour which is fixed relative to the container and which has two catch steps corresponding to the two intermediate positions and designed for bearing contact on a catch nose designed on the detent lever, an extension being designed on the actuating lever in such a way that, when the actuating lever is in the closing position, said extension cooperates with the detent lever, in order to release the latter from catch engagement with the catch contour. Such a catch arrangement does not need to contain any moving parts, besides the moveable detent lever and the moveable actuating lever, and therefore can be produced in a very simple way.

In a preferred embodiment, in which the actuating lever is mounted on a container side wall pivotably about an axis parallel to the container bottom and carries a cam follower which, when the bill container is being pushed in, comes into engagement with a control cam designed on the receiving module, it is proposed, according to the invention, that the detent lever comprise a detent pawl and a supporting pawl, parallel to the latter, which are both mounted on the container side wall pivotably about a pivot axis parallel to the pivot axis of the actuating lever, the detent pawl carrying a detent hook intended for engagement with the actuating lever and the supporting pawl being connected to the detent pawl fixedly in terms of rotation, but linearly displaceably relative to the latter, that the supporting pawl carrying the catch nose be prestressed linearly in the direction of the catch contour and, about its pivot axis, in the direction of the actuating lever, and that the extension on the actuating lever be assigned two bearing surfaces on the supporting pawl which correspond to the two intermediate positions of the detent lever.

In order to ensure that the anti-repetition device can be disconnected only by authorized personnel, according to a further feature of the invention the electromechanical setting device is secured by means of an electronic blocking circuit which can be unblocked by the entry of a code on the receiving module.

Preferably, the detent lever is assigned a position indicator which can be connected to the control circuit of the receiving module, so that the position of the detent lever can be scanned on the receiving module.

Thus, the present invention provides a bill container capable of being pushed into a receiving module of a bill dispenser unit and with a loading orifice capable of being closed by means of a lid, with a bolt for locking the lid, said bolt being secured by a lock, with an extraction orifice capable of being closed by means of a flaplike cover, with an actuating device for the positive opening or closing of the cover as a function of the movement of pushing the bill container in and pulling it out of the receiving module, and with a retrieval preventer coupled to an actuating lever of the actuating mechanism and having a detent lever which can be adjusted between a release position, in which the actuating lever can be adjusted out of a closing position corresponding to the closed cover into an open position corresponding to the opened cover, a first intermediate position, which the detent lever assumes as a function of the opening movement of the actuating lever, and a detaining position, in which the detent lever retains the actuating lever in its closing position.

In an embodiment, the present invention provides a bill container capable of being inserted into and removed from a receiving module of a bill dispenser unit. The bill container comprises a container comprising an extraction orifice releasably closed by a cover. The cover is connected to an actuating lever for moving the cover between open and closed positions. The actuating lever is coupled to an anti-repetition device for preventing unauthorized access to the interior of the container during the insertion or removal of the container from the receiving module. The actuating lever comprises an extension. The anti-repetition device comprises a detent lever releasably coupled to the actuating lever. The detent lever comprises a hook for engaging the actuating lever. The detent lever is capable of being adjusted to any one of four positions including (1) a release position which permits pivotal movement of the actuating lever away from the detent lever thereby permitting the actuating lever and cover to be moved to the open position upon insertion of the container into the receiving module, (2) a first intermediate position wherein engagement of the detent lever by the actuating lever as the actuating lever and cover move towards the closed position results in the detent lever moving to a detaining position, (3) in the detaining position, the extension of the actuating lever is trapped beneath the hook of the detent lever thereby preventing movement of the actuating lever and cover towards the open position, and (4) a second intermediate position wherein engagement of the actuating lever against the detent lever as the actuating lever and cover move towards the closed position results in the detent lever moving to the release position discussed above. The detent lever is coupled to an electromechanical setting device which, when the container is inserted into the receiving module, can move the detent lever from the first to the second intermediate position.

In an embodiment, the detent lever is releasably held in the first and second intermediate positions by a catch element. The catch element is connected to the container.

In an embodiment, the catch element comprises a first catch step for accommodating the detent lever when the detent lever is in the first intermediate position. The catch element further comprises a second catch step for accommodating the detent lever when the detent lever is in the second intermediate position.

In an embodiment, the detent lever comprises a catch nose for engaging the first and second catch steps of the catch element.

In an embodiment, the detent lever is spring biased towards engagement with the catch element.

In an embodiment, as the actuating lever moves towards the closed position, the extension of the actuating lever engages the detent lever thereby releasing the detent lever from the catch element.

In an embodiment, the receiving module comprises a control cam. The actuating lever is pivotally connected to the container about a first axis. The actuating lever further comprises a cam follower which, when the container is inserted into the receiving module, comes into engagement with the control cam.

In an embodiment, the detent lever further comprises a detent pawl and a supporting pawl. The detent pawl and the supporting pawl are disposed parallel to one another. The detent pawl and the supporting pawl are connected to the container pivotally about a second axis. The second axis is parallel to the first axis. The detent pawl is connected to the hook. The supporting pawl is rotatably connected to the detent pawl but the supporting pawl is linearly movable relative to the detent pawl. The supporting pawl is connected to the catch nose.

In an embodiment, the supporting pawl is linearly movable and spring biased towards the catch element.

In an embodiment, the supporting pawl comprises a first bearing surface for engaging the extension of the actuating lever when the detent lever is in the first intermediate position and the actuating lever is moving towards the closed position. The supporting pawl further comprises a second bearing surface for engaging the extension of the actuating lever when the detent lever is in the second intermediate position and the actuating lever is moving towards the closed position.

In an embodiment, the electromechanical setting device comprises an electronic blocking circuit which can be unblocked by entry of a code on the receiving module.

In an embodiment, the receiving module comprises a control circuit and the detent lever comprises a position indicator which can be connected electrically to the control circuit of the receiving module.

In an embodiment, the electromechanical setting device is an electromagnet.

Other objects and advantages of the present invention will become apparent from reading the following detailed description and appended claims, and upon reference to the accompanying drawings.

BRIEF DESCRIPTION OF THE DRAWINGS

Further features and advantages of the invention may be gathered from the following description which, in conjunction with the accompanying drawings, explains the invention with reference to an exemplary embodiment. In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1A:
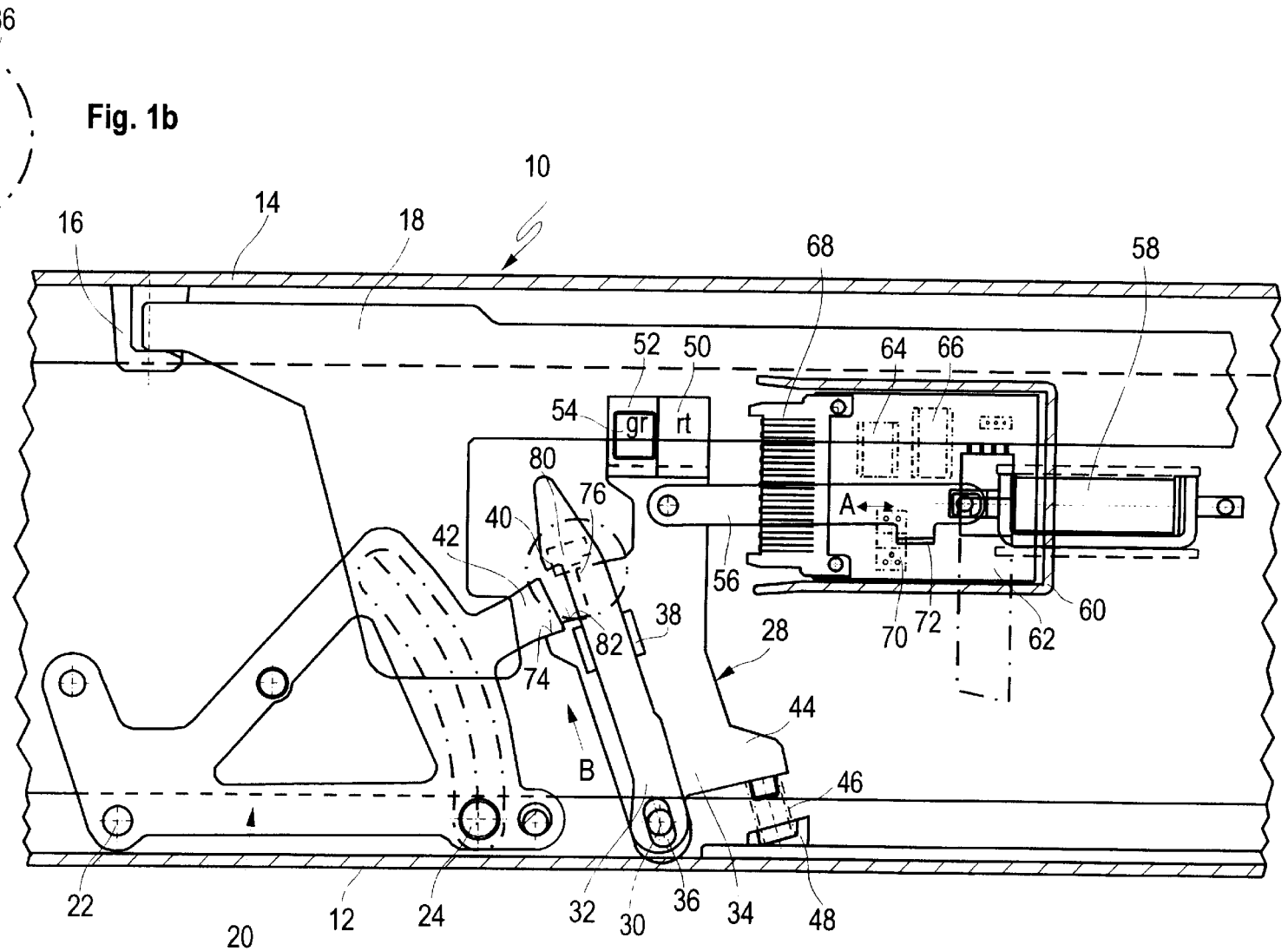
FIG. 1*a* is a partial diagrammatic sectional view taken through a bill container according to the invention, parallel to a sidewall on which the actuating lever and the anti-repetition device are pivotably mounted, with the actuating lever assuming its closed position and the detent lever its release position.
Figure 1B:
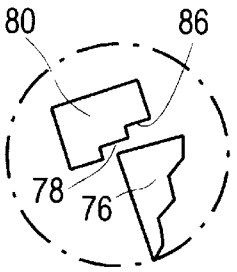
FIG. 1*b* is an enlargement of the outlined area of FIG. 1*a*.

FIG. 1*a* shows, in a part section, a bill container in the form of a bill cassette 10 which can be pushed into a receiving module, not illustrated, of an automatic bill dispenser, automated teller machine or so-called cash machine. Of the bill cassette there can be seen the bottom 12 and a lid 14 closing a loading orifice of the cassette and having, on its inside, a hook 16, into which a lid bolt 18, horizontally displaceable parallel to the drawing plane, engages. The lid bolt 18 can be displaced in the opening and closing direction in a way not illustrated as a result of the actuation of a mechanical or electronic lock.

An actuating lever, designated in general by 20, of an actuating mechanism, not illustrated, is articulated pivotably about an axis 22 on a side wall parallel to the drawing plane. The actuating mechanism serves for opening and closing a front panel, likewise not illustrated, of the bill cassette 10, said front panel closing a draw-off orifice of the bill cassette and opening said orifice only when the bill cassette is pushed into the receiving module. So that the opening and closing movement of the actuating lever out of the closing position illustrated in FIG. 1*a* into the open position illustrated in FIG. 3*a* can be controlled, the actuating lever 20 carries a pin 24 which is directed parallel to the axis 22 and which, when the cassette 10 is being pushed into the receiving module, engages into a slotted piece or guiderail 26 which is designed on the latter and which is indicated by a dot-and-dash line in FIG. 3*a*. When the cassette is being pushed into the receiving module, the actuating lever is thereby pivoted counterclockwise out of the position illustrated in FIG. 1*a* into the position illustrated in FIG. 3*a*. When the cassette is being pulled out, the movement of the actuating lever 20 takes place in the opposite direction. The front panel is thereby opened or closed relative to the receiving module as a function of the direction of movement of the cassette. For further details of this technique which is known per se, reference is made, for example, to DE-C-44 08 981.

Figure 5:
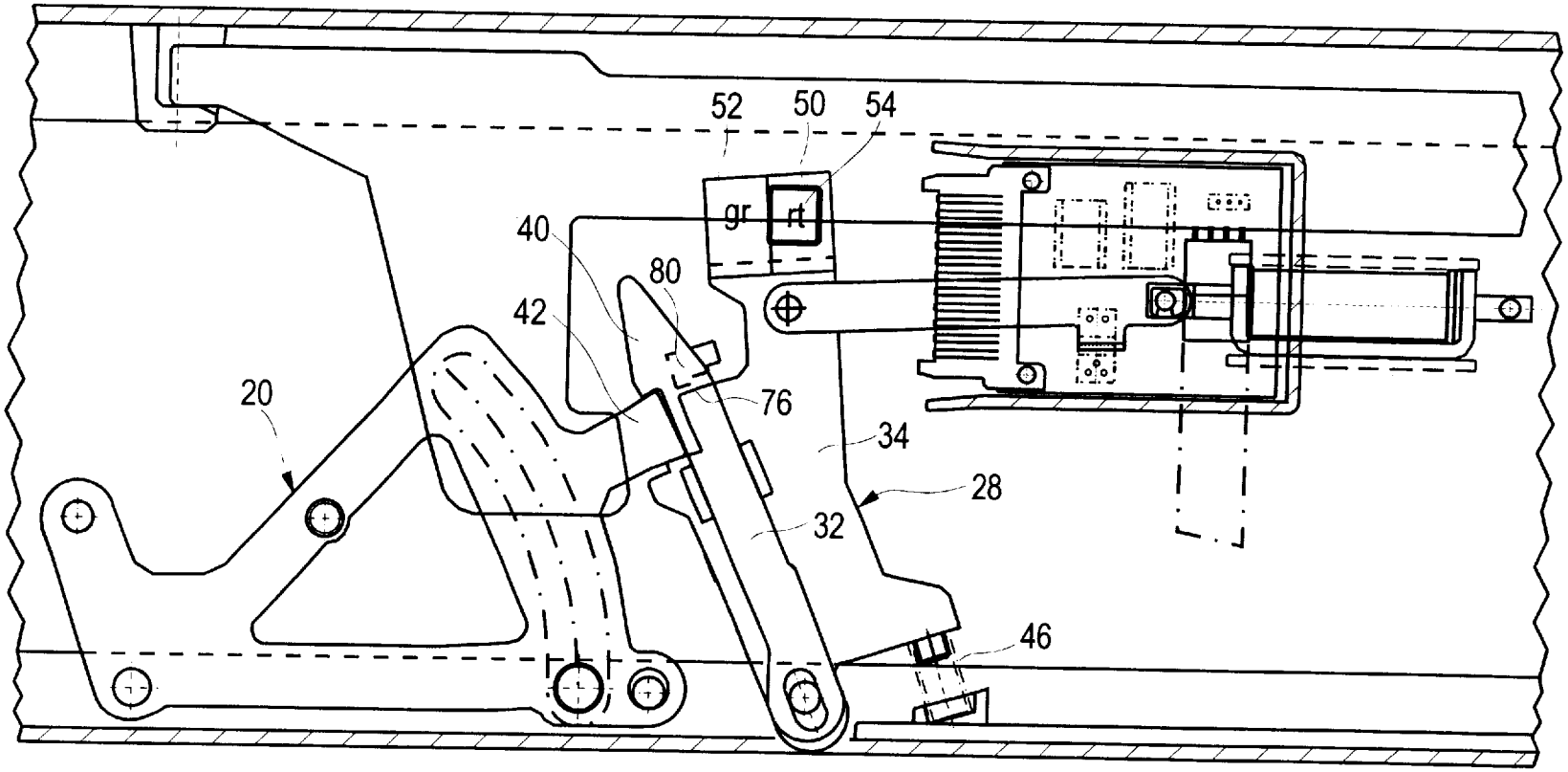
FIG. 5 is another diagrammatic sectional view corresponding to that of FIG. 1*a*, with the detent lever in its detaining position.
Figure 6:
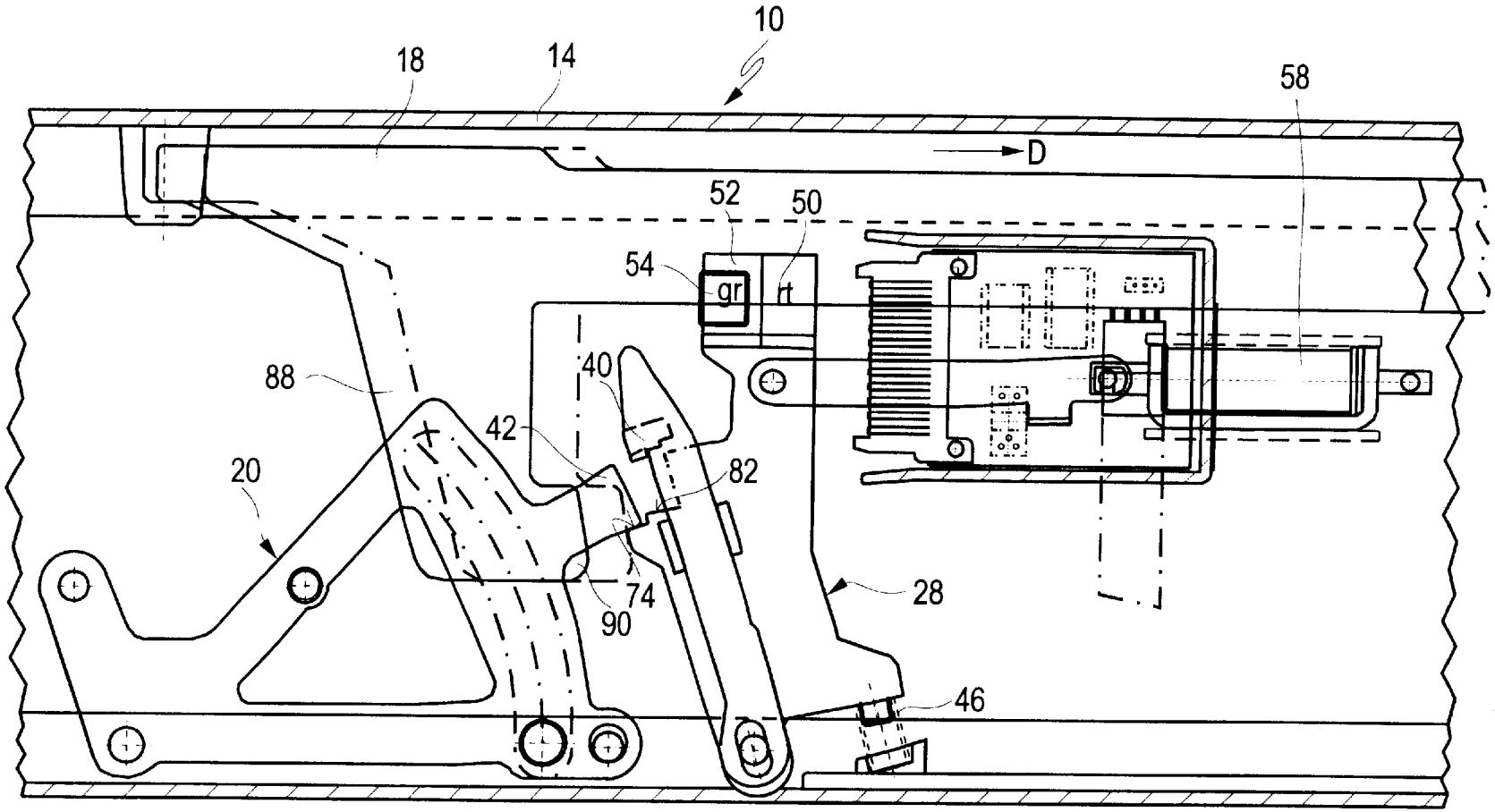
FIG. 6 is another diagrammatic sectional view corresponding to that of FIG. 1*a*, to explain the adjustment of the detent lever during the opening of the container lid.

Furthermore, a detent lever, designated in general by 28, is mounted on the same cassette side wall pivotably about a pivot pin 30 parallel to the pivot axis 22 of the actuating lever 20. The detent lever 28 comprises an elongate detent pawl 32 and a wider supporting pawl 34 parallel to the latter. The detent pawl 32 is only pivotably mounted on the pivot pin 30. The supporting pawl 34 is mounted on the pivot pin 30 by means of a long hole or slotted hole 36, so that the supporting pawl 34 can execute both a pivoting movement and a linear radial movement relative to the pivot pin 30. The detent pawl 32 and supporting pawl 34 are connected fixedly in terms of rotation, but linearly displaceably relative to one another, via a sliding guide 38. The detent pawl carries 32, at its end remote from the pivotable pin 30, a detent hook 40, by means of which said detent pawl can engage behind an extension 42, designed on the actuating lever 20, when the detent lever 28 is in the detaining position, as illustrated in FIG. 5.

The supporting pawl 34 has, at its end near the pivot pin 30, an arm 44, by means of which said supporting pawl 34 is supported via a helical compression spring 46 on a bearing 48 fixed relative to the bottom. By means of the helical compression spring 46, the supporting pawl 34 is prestressed both away from the cassette bottom 12 and counterclockwise about the pivot pin 30 in the direction of the actuating lever 20.

The supporting pawl 34 has, at its end remote from the pivot pin 30, two signal zones, for example a red signal zone 50 and a green signal zone 52, which, during the pivoting of the supporting pawl 34, can be brought alternately into coincidence with a window 54 designed in the cassette side wall, so as to make the position of the detent lever 28 visible from outside.

Below the signal zones 50, 52, the supporting pawl 34 is connected via a lever 56 to an electromagnet 58 (see FIGS. 1*a* and 3*a*), by means of which the lever 56 can be adjusted in the direction of the double arrow A and, consequently, the supporting pawl 34 can be pivoted about the axis of the pivot pin 30.

Located in a frame 60 on the side wall of the cassette is a circuit board 62 which not only carries a memory 64, in which data on the cassette and its content are stored, but also carries a single-chip controller 66, via which coded activation of the electromagnet 58 can take place. The board 62 carries, furthermore, a plug 68 which, when the cassette 10 is being pushed into the receiving module, comes together with a mating plug in the receiving module, shortly before the end position of the cassette is reached, and consequently makes it possible to connect the control device to the electronic components on the circuit board 62 and to the electromagnet 58. Furthermore, the circuit board 62 also carries a light barrier 70 which, in conjunction with an extension 72 designed on the lever 56, makes it possible to indicate the position of the lever 56 and therefore of the detent lever 28.

The functioning of the device described thus far will now be explained with reference to FIGS. 1*a* to 6.

FIG. 1*a* shows the cassette 10 in the closed state, with the detent lever 28 in the release position. In this position, the supporting pawl 34 bears with a first catch step 74 on the extension 42 under the effect of the helical compression spring 46 which attempts to rotate the supporting pawl 34 about the pin 30 and to displace it linearly in the direction of the arrow B. The signal zone 52 appears in the window 54. In this state, for example, the cassette 10 is taken over from the loading station and transported to an automatic cash dispenser. The electromagnet 58 is currentless in this state.

Figures 2A, 2B:
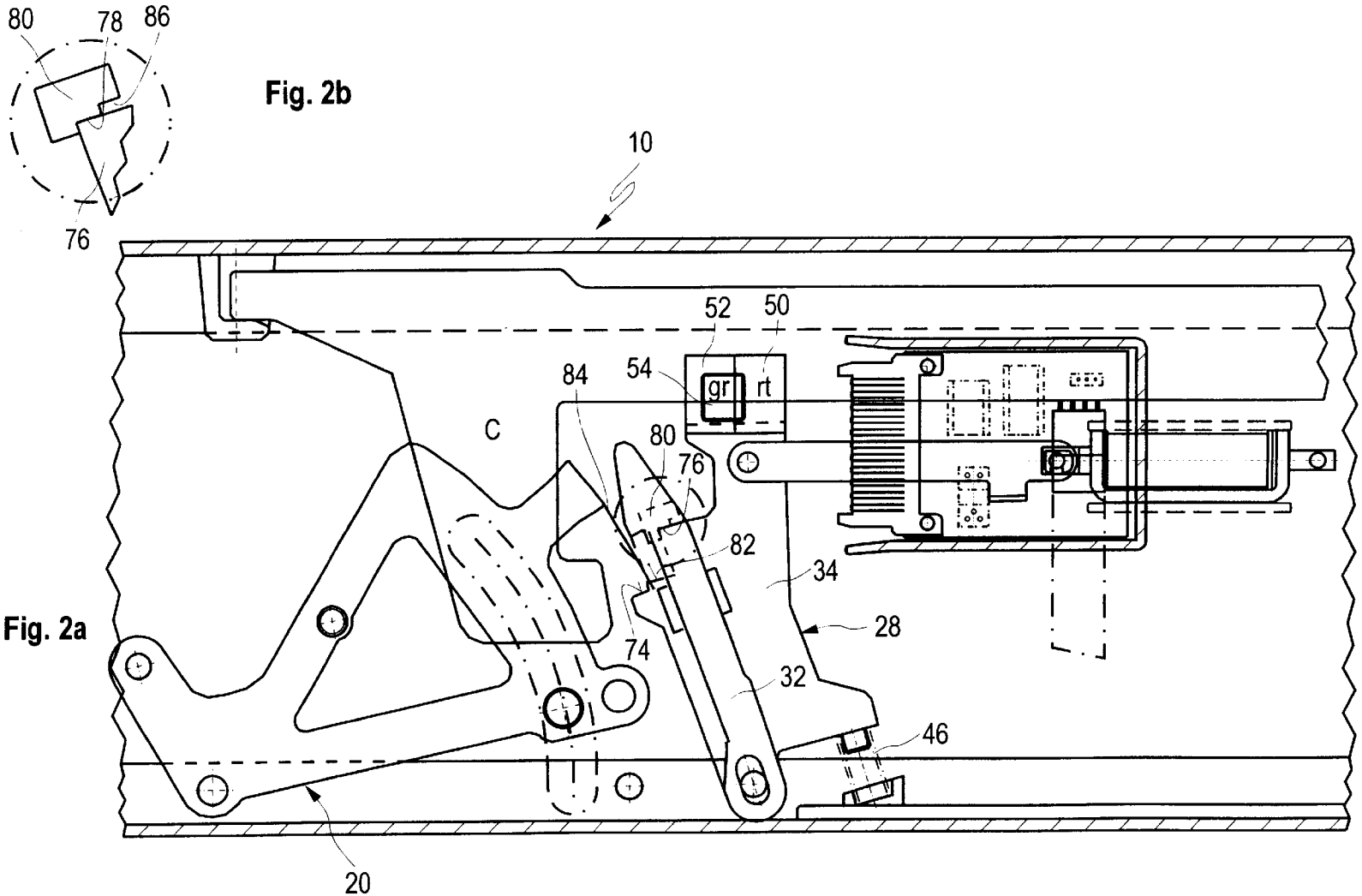
FIG. 2*a* is a partial diagrammatic sectional view corresponding to that of FIG. 1*a*, showing the actuating lever during its opening movement and the detent lever in a first intermediate position.
FIG. 2*b* is an enlargement of the outline area of FIG. 2*a*.

FIG. 2*a* shows reactions when the cassette 10 is being pushed into the receiving module which is not illustrated.

The pin 24 connected to the actuating lever 20 engages into the slotted piece designed on the receiving module and thus, when the cassette 10 is being pushed into the receiving module, pivots the actuating lever 20 in the direction of the arrow C in FIG. 2*a*, that is to say counterclockwise. The extension 42 thereby lifts off from the catch step 74 on the supporting pawl 34. The latter moves in the direction of the arrow B under the effect of the helical compression spring 46, until said supporting pawl 34 butts with a rightangled catch nose 76 against a second catch step 78 which is provided on a catch element 80 designed or fastened on the side wall of the cassette 10 (the catch element 80 and catch nose 76 are each illustrated again, enlarged, in FIGS. 1*a*, 2*b* and 3*b*). At the same time, the entire detent lever 28 executes a slight counterclockwise rotational movement, the result of which is that a step surface 82 adjacent to the first catch step 74 and located on the supporting pawl 34 comes into the pivoting path of the extension 42 of the actuating lever 20, as indicated by the dot-and-dash line 84 in FIG. 2*a*. The detent lever 28 is then in its first intermediate position. This is signaled by the fact that both the green signal zone 52 and the red signal zone 50 can be seen in the window 54.

Figure 3A:
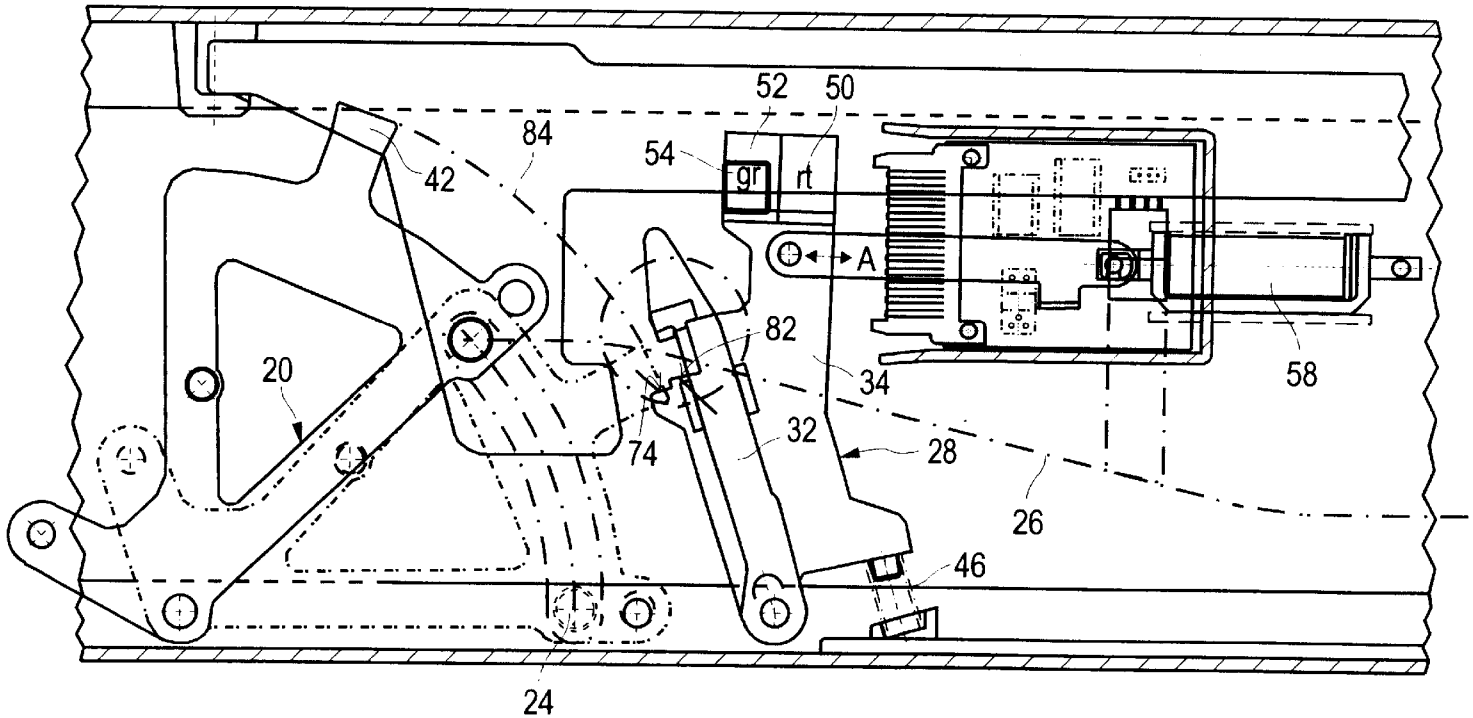
FIG. 3*a* is another diagrammatic sectional view corresponding to that of FIG. 1*a* , with the actuating lever in the open position and the detent lever in a second intermediate position.
Figure 3B:
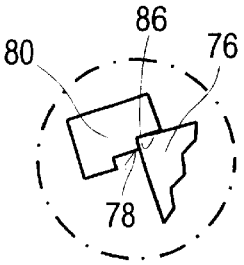
FIG. 3*b* is an enlargement of the outlined area of FIG. 3*b*.
Figure 4:
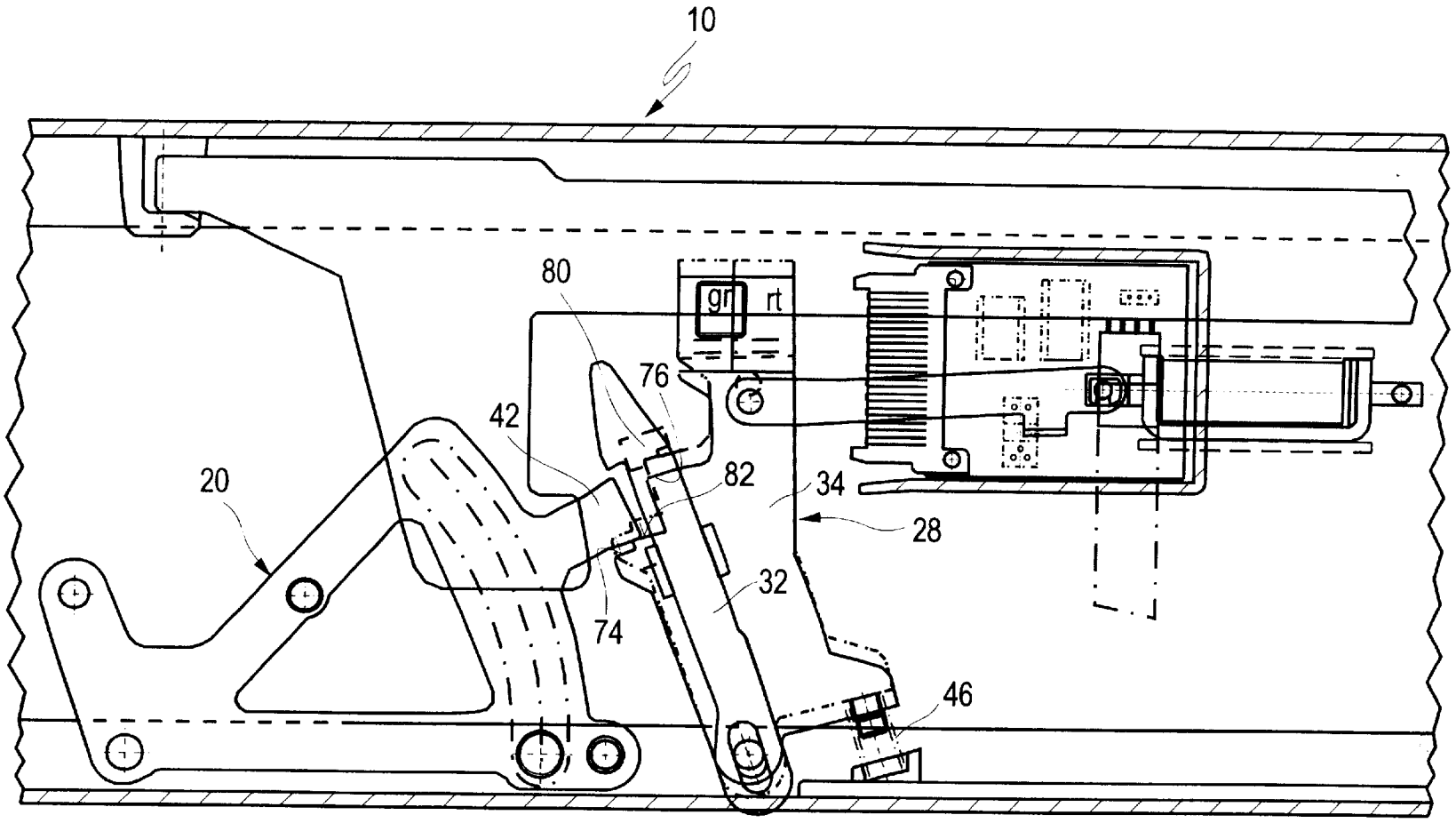
FIG. 4 is another diagrammatic sectional view corresponding to that of FIG. 1*a*, with the actuating lever returned to its closing position and with the detent lever shortly before it reaches its detaining position.

When the cassette 10 has been pushed into the receiving module completely, the actuating lever 20 is in the position represented by unbroken lines in FIG. 3*a*. In this position in which the cassette is pushed in fully, the plug 68 comes into contact with the mating plug in the receiving module, so that the elements on the circuit board 62 and the electromagnet can be connected to the control provided in the receiving module. When the cassette 10 is pulled out of the receiving module again, then, the actuating lever 20 is positively pivoted clockwise by means of the slotted control 24, 26, the extension 42 of the actuating lever 20, by following the line 84, strikes the step surface 82 on the supporting pawl 34 and presses the latter downward in the direction opposite that of the arrow B (FIG. 1*a*) and counter to the force of the spring 46. The catch nose 76 is thereby released from the catch step 78 of the catch element 80, and the detent lever 28 can execute a counterclockwise pivoting movement under the effect of the spring 46, until the detent hook 40, engaging over the extension 42 on the actuating lever 20, butts against this. At the same time, the extension 42 slides on the step surface 82 of the supporting pawl 34. This sliding movement can be assisted if the supporting pawl 34 is formed, for example, by a plastic part. The detent lever 28 is in its detaining position which is illustrated in FIG. 5. This is signaled by the red signal zone 50 which appears in the window 54. In this state, the front panel can no longer be opened and the cassette 10 also can no longer be pushed into the receiving module, since the detent pawl 32 prevents a pivoting movement of the actuating lever 20.

In order, then, to afford the possibility that the cassette can be pulled out of the receiving module and pushed in again more than once, in the solution according to the invention the detent lever 28 can be pivoted clockwise out of the first intermediate position illustrated in FIG. 2*a* into a second intermediate position illustrated in FIG. 3*a* with the aid of the electromagnet 58, in the latter position the catch nose 76 catching under the effect of the helical compression spring 46 on a third catch step 86 designed on the catch element 80, as may be seen in FIG. 3*a*. Brief actuation of the electromagnet 58 and a very short setting travel are therefore sufficient to adjust the detent lever 28 out of its first intermediate position into the second intermediate position. When the cassette 10 is pulled out of the receiving module and, at the same time, the actuating lever 20 is pivoted out of the open position illustrated by unbroken lines in FIG. 3*a* into the closing position represented by the dot-and-dash line, the extension 42 does not strike the step surface 82, but the first catch step 74 on the supporting pawl 34 and presses the latter downward counter to the force of the helical spring 46, so that the catch nose 76 of the supporting pawl 34 is released from the catch element 80. The detent lever 28 is pivoted slightly counterclockwise by the helical compression spring 46, until said detent lever assumes the release position illustrated in FIG. 1*a*. The original initial state is consequently restored. When the actuating lever 20 and detent lever 28 are in this position, the cassette 10 can be pushed into the receiving module again and the front panel opened.

The activation of the electromagnet 58 can be secured by means of a password or a code, so that only authorized persons have the possibility of disconnecting the anti-repetition device in the cassette 10 when the latter is located in the receiving module. If this disconnection has not been carried out and the detent lever 28 has fallen into the detaining position illustrated in FIG. 5 when the cassette 10 has been pulled out of the receiving module, the detent lever can be released from this detaining position only when the lid 14 of the cassette 10 is opened. This can be carried out only by authorized personnel. In order to lift the detent lever 28 out of its detaining position, there is a hooklike extension 88 which is connected to the lid bolt 18 and which, when the lid bolt is pulled back in the direction of the arrow D in FIG. 6, butts with a hook nose 90 against the supporting pawl 34 and pivots the latter clockwise, so that the extension 42 of the actuating lever 20 catches in the first catch step 74 on the supporting pawl 34. The detent lever 28 is consequently once again in the release position illustrated in FIG. 1*a*.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A bill container capable of being inserted into and removed from a receiving module of a bill dispenser unit, the bill container comprising:

the container comprising an extraction orifice releasably closed by a cover, the cover being connected to an actuating lever for moving the cover between open and closed positions, the actuating lever being coupled to an anti-repetition device for preventing unauthorized access to the interior of the container during the insertion or removal of the container from the receiving module, the actuating lever comprising an extension, the anti-repetition device comprising a detent lever releasably coupled to the actuating lever, the detent lever comprising a hook for engaging the actuating lever, the detent lever capable of being adjusted to any one of at least four positions including a release position which permits pivotal movement of the actuating lever away from the detent lever thereby permitting the actuating lever and cover to be moved to the open position upon insertion of the container into the receiving module, a first intermediate position wherein engagement of the detent lever by the actuating lever as the actuating lever and cover move towards the closed position results in the detent lever moving to a detaining position, the detaining position wherein the extension of the actuating lever is trapped beneath the hook of the detent lever thereby preventing movement of the actuating lever and cover towards the open position, and a second intermediate position wherein engagement of the actuating lever against the detent lever as the actuating lever and cover move towards the closed position results in the detent lever moving to the release position, the detent lever being coupled to an electromechanical setting device which, when the container inserted into the receiving module, can move the detent lever from the first to the second intermediate position.

2. The container of claim 1 wherein the detent lever is releasably held in the first and second intermediate positions by a catch element, the catch element being connected to the container.

3. The container of claim 2 wherein the catch element comprises a first catch step for accommodating the detent lever when the detent lever is in the first intermediate position, the catch element comprising a second catch step for accommodating the detent lever when the detent lever is in the second intermediate position.

4. The container of claim 3 wherein the detent lever comprises a catch nose for engaging the first and second catch steps of the catch element.

5. The container of claim 2 wherein the detent lever is spring biased towards engagement with the catch element.

6. The container of claim 5 wherein as the actuating lever moves towards the closed position, the extension of the actuating lever engages the detent lever thereby releasing the detent lever from the catch element.

7. The container of claim 6 wherein the receiving module comprises a control cam, the actuating lever being pivotally connected to the container about a first axis, the actuating lever further comprising a cam follower which, when the container is being inserted into the receiving module, comes into engagement with the control cam.

8. The container of claim 7 wherein the detent lever further comprises a catch nose for engaging the catch element, a detent pawl, and a supporting pawl connected to the catch nose, the detent pawl and supporting pawl being disposed parallel to one another, the detent pawl and supporting pawl being connected to the container pivotally about a second axis, the second axis being parallel to the first axis, the detent pawl being connected to the hook, the supporting pawl being rotatably connected to the detent pawl but the supporting pawl being linearly movable relative to the detent pawl.

9. The container of claim 8 wherein the supporting pawl is linearly movable and spring biased towards the catch element.

10. The container of claim 9 wherein the supporting pawl comprises a first bearing surface for engaging the extension of the actuating lever when the detent lever is in the first intermediate position and the actuating lever is moving towards the closed position and the supporting pawl comprises a second bearing surface for engaging the extension of the actuating lever when the detent lever is in the second intermediate position and the actuating lever is moving towards the closed position.

11. The container of claim 1 wherein the electromechanical setting device comprises an electronic blocking circuit which can be unblocked by the entry of a code on the receiving module.

12. The container of claim 1 wherein the receiving module comprises a control circuit and the detent lever comprises a position indicator which can be connected electrically to the control circuit of the receiving module.

13. The container of claim 1 wherein the electromechanical setting device is an electromagnet.

* * * * *